US008259025B2

(12) United States Patent
Swais et al.

(10) Patent No.: US 8,259,025 B2
(45) Date of Patent: Sep. 4, 2012

(54) MULTI-BAND ANTENNA ASSEMBLIES

(75) Inventors: Imad M. Swais, Bloomingdale, IL (US); Rafael Haro, Chicago, IL (US)

(73) Assignee: Laird Technologies, Inc., Earth City, MO (US)

( * ) Notice: Subject to any disclaimer, the term of this patent is extended or adjusted under 35 U.S.C. 154(b) by 710 days.

(21) Appl. No.: 12/412,231

(22) Filed: Mar. 26, 2009

(65) Prior Publication Data

US 2010/0245200 A1 Sep. 30, 2010

(51) Int. Cl.
*H01Q 9/04* (2006.01)

(52) U.S. Cl. ..... 343/790; 343/792; 343/745

(58) Field of Classification Search ..... 343/790–792
See application file for complete search history.

(56) References Cited

U.S. PATENT DOCUMENTS

| | | | | |
|---|---|---|---|---|
| 2,839,752 A | | 6/1958 | Webster | |
| 3,226,725 A | | 12/1965 | Ritchie et al. | |
| 3,798,654 A | * | 3/1974 | Martino et al. | 343/745 |
| 5,202,696 A | | 4/1993 | Sheriff | |
| 5,512,914 A | | 4/1996 | Hadzoglou et al. | |
| 6,020,861 A | | 2/2000 | Jonsson et al. | |
| 6,057,804 A | * | 5/2000 | Kaegebein | 343/792 |
| 6,177,911 B1 | | 1/2001 | Yuda et al. | |
| 2004/0017323 A1 | | 1/2004 | Martiskainen et al. | |
| 2005/0073465 A1 | | 4/2005 | Olson | |

FOREIGN PATENT DOCUMENTS

| | | |
|---|---|---|
| JP | 09-036632 | 2/1997 |
| JP | 2003-249817 | 9/2003 |
| JP | 2003-318616 | 11/2003 |
| JP | 2004-254002 | 9/2004 |
| JP | 2005-086794 | 3/2005 |
| WO | WO 2010/111190 | 9/2010 |

OTHER PUBLICATIONS

International Search Report and Written Opinion from PCT/US2010/028172, which is related to the instant application through a priority claim; Oct. 29, 2010; 12 pages.

* cited by examiner

*Primary Examiner* — Jacob Y Choi
*Assistant Examiner* — Kyana R McCain
(74) *Attorney, Agent, or Firm* — Harness, Dickey & Pierce, P.L.C.

(57) ABSTRACT

A multi-band antenna assembly that is operable to receive and/or transmit signals at one or more frequencies generally includes at least two radiating elements, a transmission line coupled to each of the at least two radiating elements, and a tunable match resonator coupled to the transmission line. The tunable match resonator is operable to vary input impedance of a signal received and/or transmitted by the antenna assembly by changing an electrical field within the tunable match resonator.

25 Claims, 7 Drawing Sheets

MULTI-BAND ANTENNA ASSEMBLIES

FIELD

The present disclosure relates generally to antenna assemblies, and more particularly to multi-band coaxial antenna assemblies for use with, for example, base station subsystems of wireless communications networks.

BACKGROUND

This section provides background information related to the present disclosure which is not necessarily prior art.

Multi-band antenna assemblies such as, for example, coaxial antenna assemblies, are often used in base station subsystems of wireless communications networks. And, the base station subsystems may be used in communicating with, for example, wireless application devices, such as cellular phones, personal digital assistants (PDAs), etc. Such use is continuously increasing. Consequently, additional frequency bands are required (at lowered costs) to accommodate the increased use, and antenna assemblies capable of handling the additional different frequency bands are desired.

SUMMARY

This section provides a general summary of the disclosure, and is not a comprehensive disclosure of its full scope or all of its features.

Example embodiments of the present disclosure are generally directed toward multi-band antenna assemblies operable to receive and/or transmit signals at one or more frequencies. In one example embodiment, a multi-band antenna assembly generally includes at least two radiating elements, a transmission line coupled to each of the at least two radiating elements, and a tunable match resonator coupled to the transmission line and operable to vary input impedance of a signal received and/or transmitted by the antenna assembly by changing an electrical field within the tunable match resonator.

Example embodiments of the present disclosure are also generally directed toward tunable match resonators for antenna assemblies. In one example embodiment, a tunable match resonator generally includes a generally tubular radiating element, a loading rod disposed at least partially within the radiating element; a balun coupled to the loading rod, and a dielectric load bushing coupled to the balun. The balun and the dielectric load bushing are disposed at least partially within the radiating element. And, the balun and the dielectric load bushing are moveable relative to the loading rod for varying input impedance of a signal received and/or transmitted by an antenna assembly by changing an electrical field within the tunable match resonator. Whereby the tunable match resonator is operable to adjust the frequency bandwidth of signals capable of being received and/or transmitted by an antenna assembly.

Example embodiments of the present disclosure are also generally directed toward multi-band array antenna assemblies operable to receive and/or transmit signals at one or more frequencies. In one example embodiment, an array antenna assembly generally includes first, second, and third open-ended radiating tubes oriented in a generally stacked configuration, a coaxial cable extending generally through each of the first and second radiating tubes, and a loading rod coupled to the coaxial cable and extending generally through the third radiating tube. A balun is coupled to the loading rod generally within the third radiating tube and moveable longitudinally relative to the loading rod within the third radiating tube. And, a dielectric load bushing is coupled to the balun. The balun and the dielectric load bushing are operable to vary input impedance of a signal received and/or transmitted by the array antenna assembly by changing an electrical field within the third radiating tube to thereby adjust the frequency bandwidth of signals capable of being received and/or transmitted by the array antenna assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
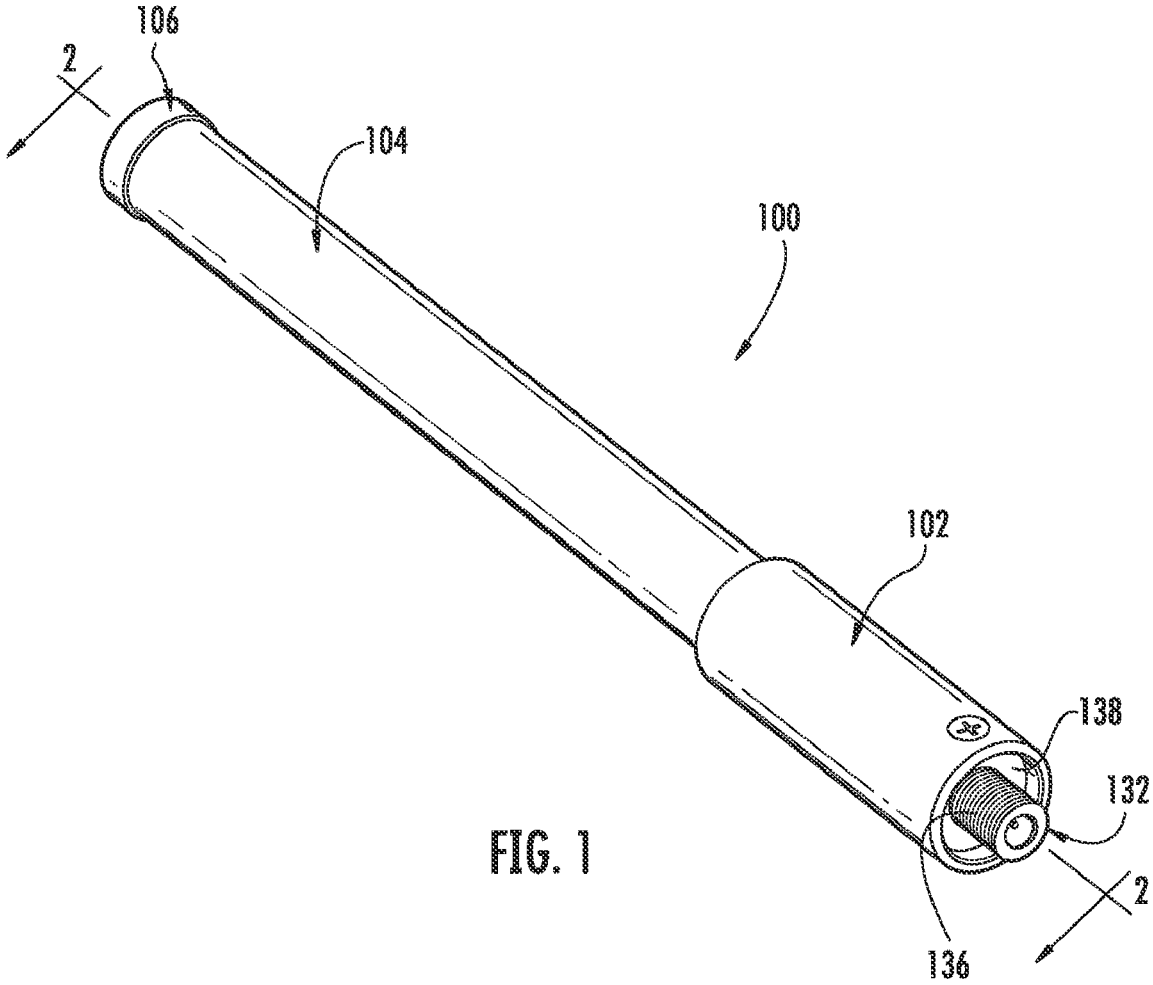
FIG. 1 is a perspective view of an example embodiment of an antenna assembly including one or more aspects of the present disclosure.
Figure 4:
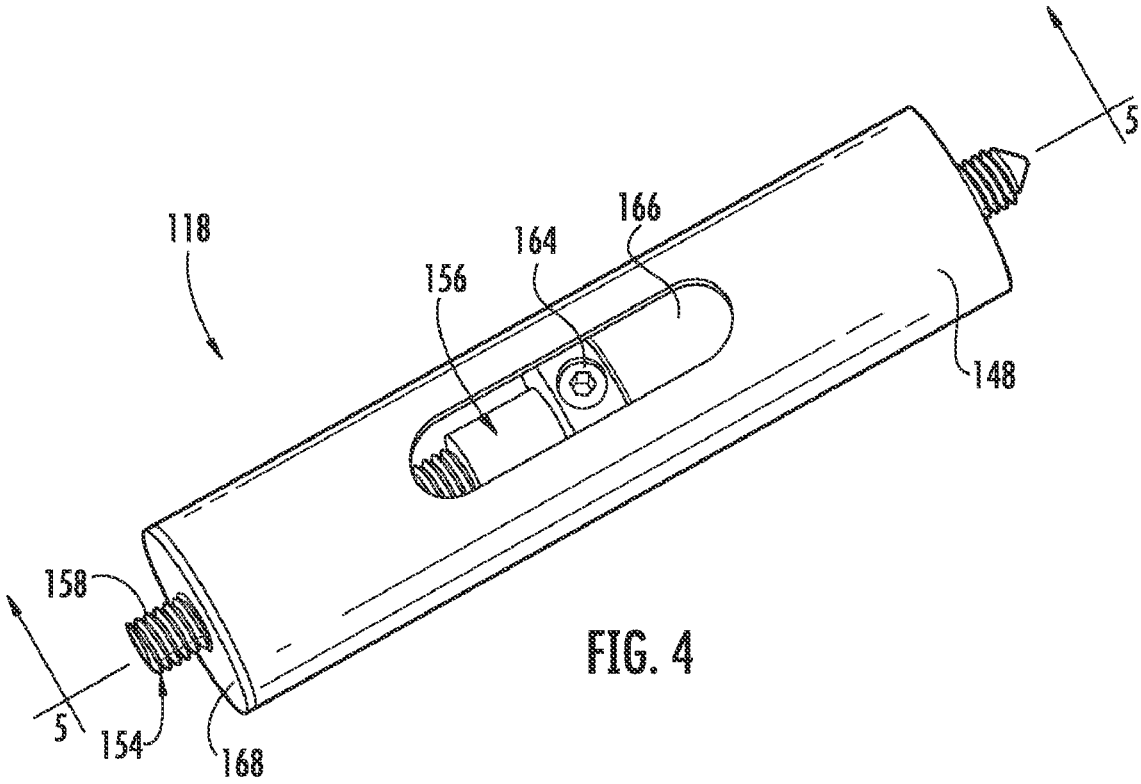
FIG. 4 is a perspective view of a tunable match resonator of the antenna assembly of FIG. 1.
Figure 6:
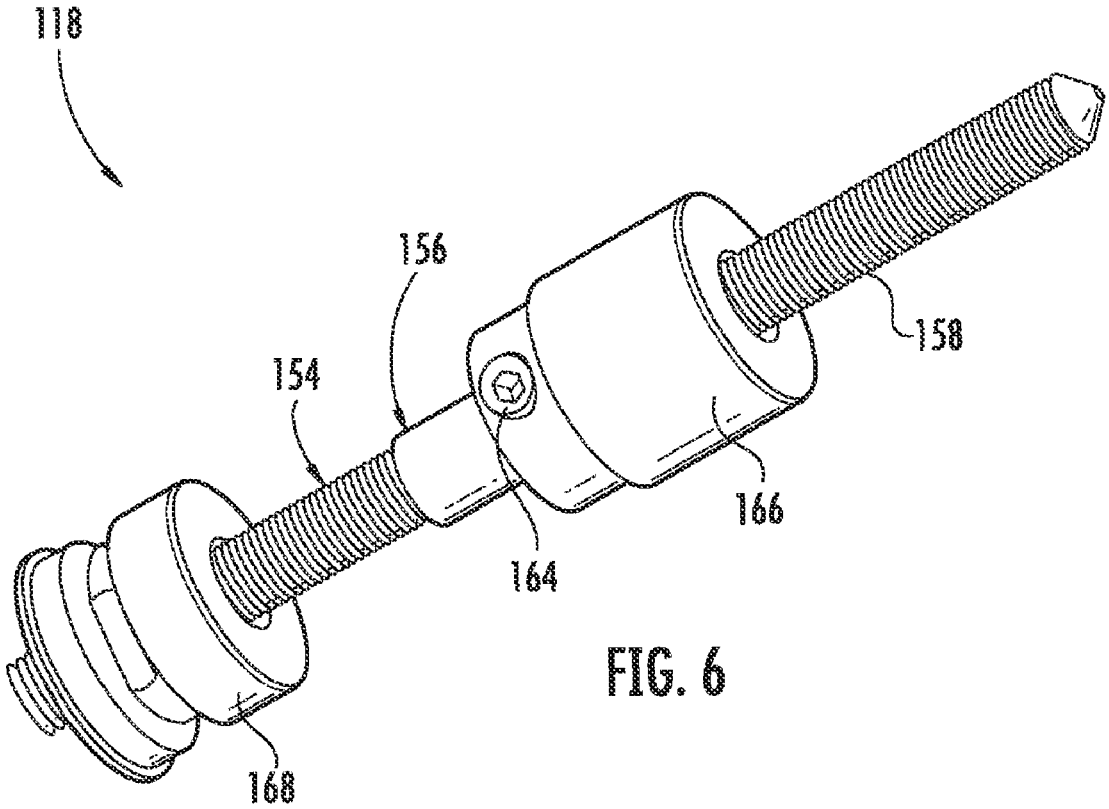
Figure 7:
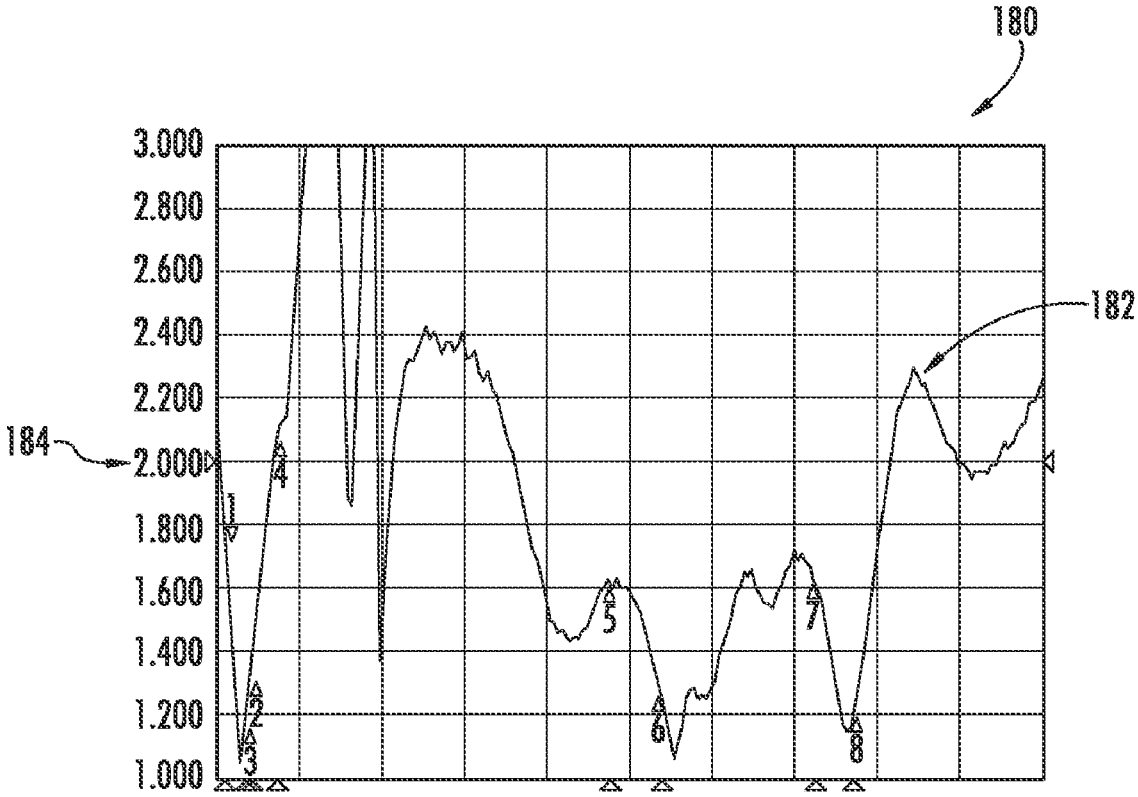

FIG. 6 is a perspective view of the tunable match resonator of FIG. 4 with a match resonator radiating element removed to show internal construction of the tunable match resonator; and FIG. 7 is a line graph illustrating voltage standing wave ratios (VSWRs) for the example antenna assembly shown in FIG. 1 over a frequency bandwidth of about 800 MHz to about 3000 MHz and with an intermediate frequency bandwidth (IFBW) of about 70 KHz.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises", "comprising", "including", and "having", are inclusive and therefore specify the presence of stated features, integers, steps, operations, elements, and/or components, but do not preclude the presence or addition of one or more other features, integers, steps, operations, elements, components, and/or groups thereof. The operations described herein are not to be construed as necessarily requiring their performance in the particular order discussed or illustrated, unless specifically identified as an order of performance.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on", "directly engaged to", "directly connected to" or "directly coupled to" another element or layer, there may be no intervening elements or layers present. Other words used to describe the relationship between elements should be interpreted in a like fashion (e.g., "between" versus "directly between", "adjacent" versus "directly adjacent", etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second", and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner", "outer", "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

According to various aspects of the present disclosure, antenna assemblies (e.g., coaxial antenna assemblies, etc.) are provided suitable for operation over different bands of wavelengths (e.g., multi-band operation, etc.). For example, antenna assemblies of the present disclosure may be tuned to multiple different resonant frequencies such that the antenna assemblies are operable to receive and/or transmit multiple different frequencies of signals over multiple different bands of wavelengths.

For example, antenna assemblies of the present disclosure may be suitable for operation over bandwidths ranging between about 804 megahertz (MHz) and about 829 MHz (Advanced Mobile Phone System (AMPS)), between about 806 MHz and about 941 MHz (Integrated Digital Enhanced Network (iDEN)), between about 855 MHz and about 980 MHz (Global System for Mobile communications (GSM)), between about 1660 MHz and about 1910 MHz, between about 1670 MHz and about 1920 MHz (Digital Cellular System (DCS)), between about 1790 MHz and 2010 MHz (Personal Communications Service (PCS)), between about 1920 MHz and about 2170 MHz (Universal Mobile Telecommunications System (UMTS)), between about 2400 MHz and about 2500 MHz (Industrial, Scientific and Medical (ISM)), etc. While the foregoing provides an example listing of bandwidths over which example antenna assemblies are operable, it should be appreciated that antenna assemblies of the present disclosure may also be tuned, as desired, to suit for operation over bandwidths having different frequency ranges within the scope of the present disclosure.

Antenna assemblies of the present disclosure may be used, for example, with systems and/or networks and/or devices such as those associated with cellular systems, wireless internet service provider (WISP) networks, broadband wireless access (BWA) systems, wireless local area networks (WLANs), wireless application devices, etc. As an example, the antenna assemblies may be included as part of base station subsystems, operable for helping to handle traffic and signaling (e.g., sending signals, receiving signals, etc.) between wireless devices (e.g., cellular phones, etc.) and network switching subsystems.

With reference now to the drawings, FIGS. 1 through 6 illustrate an example embodiment of an antenna assembly 100 including one or more aspects of the present disclosure. The illustrated antenna assembly 100 may be included as part of a base station subsystem (not shown) of a cellular telephone network. And, as will be described in more detail hereinafter, the antenna assembly 100 may be tuned to multiple different resonant frequencies over multiple different bandwidths for enhancing operation of the base station subsystem.

As shown in FIG. 1, the illustrated antenna assembly 100 generally includes a base sleeve 102, a housing 104 coupled to the base sleeve 102, and a cap 106 coupled to the housing 104. The base sleeve 102 is generally tubular in shape and may be constructed from suitable metallic materials such as, for example, aluminum, etc. The housing 104 is also generally tubular in shape and is coupled to the base sleeve 102, for example, by a threaded connection (e.g., via mating threads 110 and 112 respectively on the housing 104 and on the base sleeve 102 (FIG. 2), etc.) and/or by an epoxy connection, etc. The housing 104 may be constructed from suitable insulating materials such as, for example, fiberglass, etc. And, the cap 106 may be coupled to the housing 104 by suitable means (e.g., epoxy connections, weld connections, threaded connections, etc.), and may be constructed from suitable metallic materials.

The base sleeve 102, the housing 104, and the cap 106 may help protect the components of the antenna assembly 100 enclosed within an interior defined by the base sleeve 102, the housing 104, and the cap 106 against mechanical damage, etc. The base sleeve 102, the housing 104, and the cap 106 may also provide an aesthetically pleasing appearance to the antenna assembly 100. Base sleeves, housings, and caps may be configured (e.g., shaped, sized, constructed, etc.) differently than disclosed herein within the scope of the present disclosure.

Figure 2:
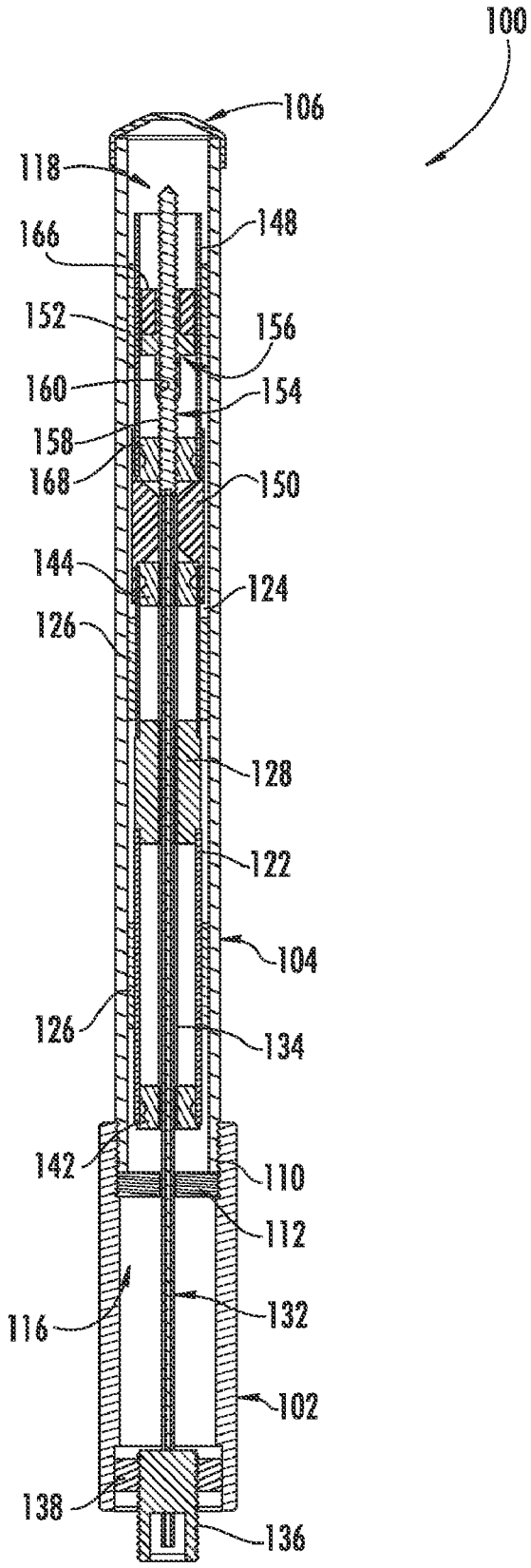
FIG. 2 is a section view of the antenna assembly of FIG. 1 taken in a plane including line 2-2 in FIG. 1.
Figure 3:
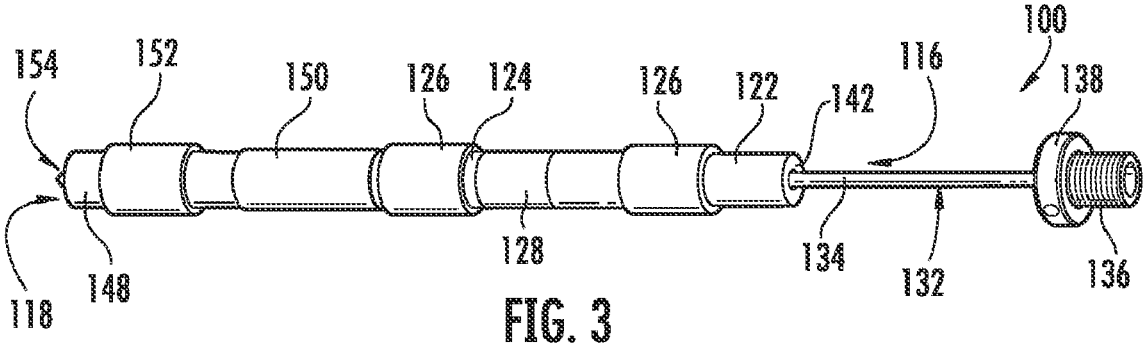
FIG. 3 is a perspective view of the antenna assembly of FIG. 1 with a base sleeve, a housing, and a cap removed to show internal construction of the antenna assembly.

With additional reference now to FIGS. 2 and 3, the illustrated antenna assembly 100 also generally includes a coaxial antenna module 116 and a tunable match resonator 118 (e.g., an attenuator, etc.) coupled to the coaxial antenna module 116. The coaxial antenna module 116 and the match resonator 118 are each disposed generally within the interior defined by the base sleeve 102, the housing 104, and the cap 106, with the match resonator 118 being coupled to the coaxial antenna module 116 generally toward an upper end portion of the coaxial antenna module 116 (e.g., as viewed in FIG. 2, etc.).

And, the tunable match resonator 118, which will be described in more detail hereinafter, is operable to adjust the frequency bandwidth of signals capable of being received and/or transmitted by the antenna assembly 100 (e.g., by the coaxial antenna module 116, etc.).

The illustrated coaxial antenna module 116 is a double array quarter-wave coaxial antenna module, having first and second generally tubular-shaped radiating elements 122 and 124 (also termed, conductors, etc.) oriented within the housing 104 of the antenna assembly 100 in a generally stacked configuration. The first and second radiating elements 122 and 124 each generally define an open-ended radiating sleeve (or, radiating tube, etc.). And, the first radiating element 122 is located toward a lower end portion of the housing 104 (as viewed in FIG. 2), and the second radiating element 124 is located toward a longitudinal center of the housing 104, generally above the first radiating element 122 (as viewed in FIG. 2). In other example embodiments, antenna assemblies may include coaxial antenna modules other than double array half-wave dipole coaxial antenna modules, may include antenna modules with less than or more than two radiating elements, etc.

Foam cushions 126 are provided around each of the first and second radiating elements 122 and 124 (generally between the radiating elements 122 and 124 and the housing 104 (FIG. 2)) to, for example, help centrally stabilize the radiating elements 122 and 124 within the housing 104 (e.g., help stabilize movements of the radiating elements 122 and 124, etc.) and/or help absorb vibrations (e.g., within the housing 104, etc.). And, an insulator 128 (e.g., a dual array split insulator formed from suitable dielectric materials, etc.) is provided generally between the first and second radiating elements 122 and 124 for separating the first and second radiating elements 122 and 124. For example, the insulator 128 may operate to electrically insulate the first radiating element 122 from the second radiating element 124 during operation.

With continued reference to FIGS. 2 and 3, the illustrated coaxial antenna module 116 also generally includes a transmission line 132 (also termed, a feed line, etc.) extending generally through the first and second radiating elements 122 and 124 (and through the insulator 128 provided generally between the first and second radiating elements 122 and 124). The transmission line 132 is coupled (e.g., capacitively coupled, etc.) to each of the first and second radiating elements 122 and 124, and is configured to electrically couple the antenna assembly 100 (e.g., the coaxial antenna module 116, the match resonator 118, etc.) to one or more components of a base station to which the antenna assembly 100 may be mounted (e.g., to one or more printed circuit boards of a receiver, a transmitter, etc. of the base station, etc.). As such, the transmission line 132 may be used as a transmission medium between the antenna assembly 100 and the base station.

The illustrated transmission line 132 generally includes a hard line coaxial cable 134 (e.g., a radiating rod, etc.) and a coaxial connector 136. The hard line coaxial cable 134 is disposed generally within the base sleeve 102 and the housing 104 of the antenna assembly 100, and extends generally through the first and second radiating elements 122 and 124. The coaxial connector 136 is provided toward a lower end portion of the hard line coaxial cable 134 (e.g., as viewed in FIG. 2, etc.) and extends generally outwardly from the base sleeve 102 (see also, FIG. 1). The coaxial connector 136 is configured to electrically couple the hard line coaxial cable 134 (and the antenna assembly 100) to a base station, as desired. The hard line coaxial cable 134 may include any suitable coaxial cable. For example, the hard line coaxial cable 134 may include a coaxial cable having a metallic (e.g., copper, copper plated aluminum, etc.) central conductor, a dielectric insulator (e.g., a polyethylene foam, etc.) surrounding the central conductor, a metallic (e.g., copper, silver, gold, aluminum, combinations thereof, etc.) shield surrounding the dielectric insulator, and a polyvinyl chloride jacket surrounding the metallic shield. And, the coaxial connector 136 may include any suitable connector within the scope of the present disclosure (e.g., an I-PEX connector, a SMA connector, a MMCX connector etc.).

A bushing 138 is provided toward a lower end portion of the base sleeve 102 for supporting the transmission line 132 (e.g., the coaxial connector 136, etc.) in a generally radially-centered position within the base sleeve 102 (FIG. 2). And, first and second supports 142 and 144 (e.g., first and second support bases, etc.) are provided generally within the respective first and second radiating elements 122 and 124 (FIG. 2) for supporting the transmission line 132 (e.g., the hard line coaxial cable 134 extending from the coaxial connector 136, etc.) in the generally radially-centered position within the first and second radiating elements 122 and 124 (e.g., generally along longitudinal axes of the first and second radiating elements 122 and 124, etc.). The first and second supports 142 and 144 may also help support (e.g., help structurally support, etc.) the respective first and second radiating elements 122 and 124 in their generally tubular shapes against, for example, undesired deformation, etc.

Figure 5:
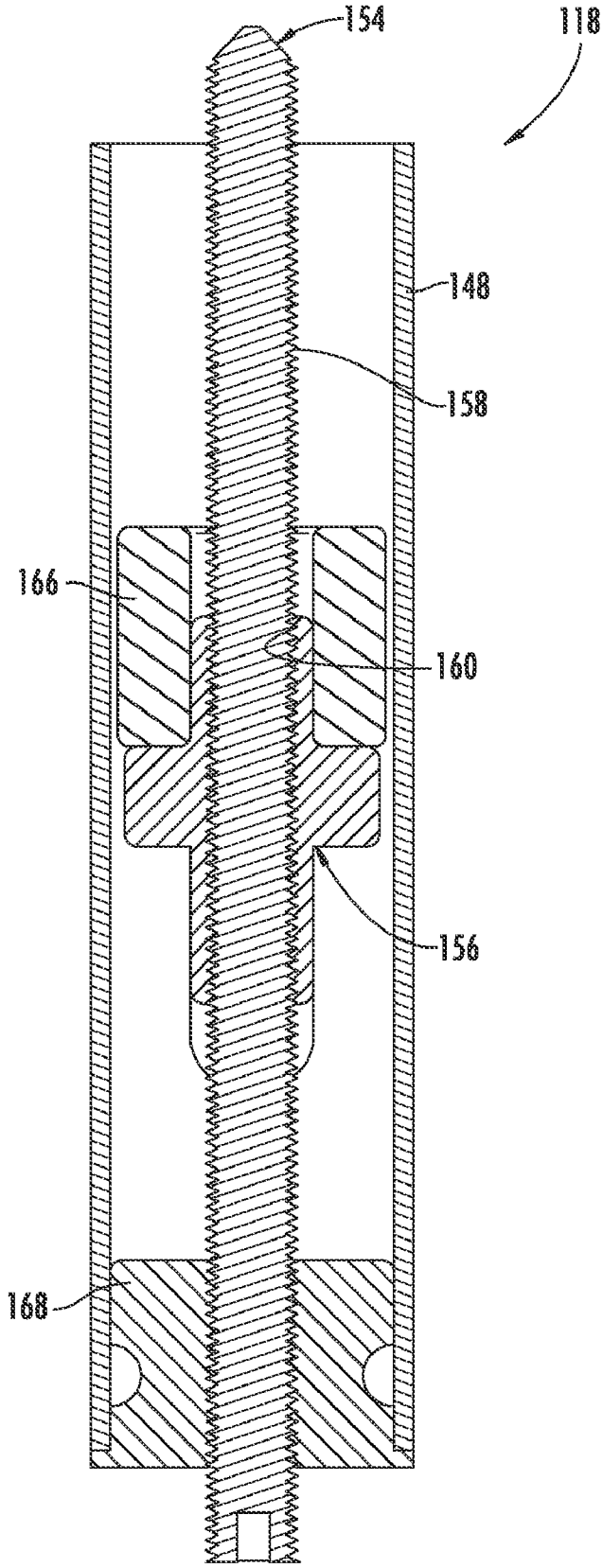
FIG. 5 is a section view of the tunable match resonator of FIG. 1 taken in a plane including line 5-5 in FIG. 4.

With additional reference now to FIGS. 4 through 6, the tunable match resonator 118 of the illustrated antenna assembly 100 generally includes a radiating element 148 (also termed, a conductor) disposed within an upper end portion of the housing 104 (e.g., as viewed in FIG. 2, etc.). The match resonator radiating element 148 is oriented within the housing 104 in generally stacked alignment with the first and second radiating elements 122 and 124 of the coaxial antenna module 116. And, the illustrated match resonator radiating element 148 includes a generally tubular-shape (similar to that of the first and second radiating elements 122 and 124 of the coaxial antenna module 116) such that it generally defines an open-ended radiating sleeve (or, radiating tube, etc.).

An insulator 150 (e.g., a radiator rod insulator formed from suitable dielectric materials, etc.) (FIG. 2) is provided generally between the second radiating element 124 of the coaxial antenna module 116 and the match resonator radiating element 148 for separating the second radiating element 124 from the match resonator radiating element 148. The insulator 150 may, for example, operate to electrically insulate the second radiating element 124 from the match resonator radiating element 148. And, a foam cushion 152 (FIGS. 2 and 3) is provided around the match resonator radiating element 148 (generally between the match resonator radiating element 148 and the housing 104) to, for example, help centrally stabilize the match resonator radiating element 148 within the housing 104 (e.g., help stabilize movements of the match resonator radiating element 148, etc.) and/or help absorb vibrations (e.g., within the housing 104, etc.).

The tunable match resonator 118 also generally includes a loading rod 154 and a balun 156 (broadly, a transformer) coupled to the loading rod 154. The loading rod 154 is disposed generally within (and extends generally through) the match resonator radiating element 148. And, the balun 156 is coupled to the loading rod 154 generally within the match resonator radiating element 148, and is adjustable relative to the loading rod 154 (e.g., within the match resonator radiating element 148, etc.) for varying a position of the balun 156 relative to the loading rod 154 (i.e., such that the loading rod 154 can accommodate a variable position of the balun 156). This allows the tunable match resonator 118 to vary input impedance, for example, of a radio frequency signal (e.g., received and/or transmitted by the antenna assembly 100, etc.) by changing an electrical field within the match resonator radiating element 148, and thereby allows the tunable match resonator 118 to adjust the frequency bandwidth of signals capable of being received and/or transmitted by the antenna assembly 100.

In the illustrated embodiment, for example, the balun 156 is coupled to the loading rod 154 by a threaded connection (e.g., via external threads 158 of the loading rod 154 and mating internal threads 160 of the balun 156 (e.g., located within a channel extending through the balun 156, etc.) (FIG. 4), etc.). This allows the balun 156 to be moved longitudinally along the loading rod 154 by, for example, rotating the balun 156 relative to the loading rod 154 (such that the threaded connection supports movement of the balun longitudinally along the loading rod 154). A set screw 164 is provided for selectively holding (e.g., releasably securing, etc.) the balun 156 in a desired position along the loading rod 154 to adjust the balun 156 and thus vary the input impedance of the signals received and/or transmitted by the antenna assembly 100. The balun 156 may be coupled to the loading rod 154 other than by a threaded connection (e.g., by a friction-based coupling, a sliding connection, etc.) within the scope of the present disclosure.

With continued reference to FIGS. 4 through 6, a bushing 166 (e.g., a dielectric load bushing formed from a dielectric material, etc.) is located within the match resonator radiating element 148 (generally above the balun 156, as viewed in FIG. 4). The bushing 166 is coupled to the balun 156 (e.g., by a pressure compression fit, etc.) such that the bushing 166 is moveable with the balun 156 relative to the loading rod 154. As such, the bushing 166 may help structurally support movement of the balun 156 relative to the loading rod 154 within the match resonator radiating element 148. The bushing 166 can help increase the sensitivity of the balun 156 to obtain a fine tuning capability of the antenna assembly 100.

A support 168 (e.g., a support base, etc.) is located generally within the match resonator radiating element 148 for further supporting the loading rod 154 in a generally radially-centered position within the match resonator radiating element 148 (e.g., generally along a longitudinal axis of the match resonator radiating element 148, etc.). The support 168 may also help support (e.g., help structurally support, etc.) the match resonator radiating element 148 in its generally tubular shape against, for example, undesired deformation, etc.

Referring again to FIG. 2, the loading rod 154 of the tunable match resonator 118 generally couples the tunable match resonator 118 to the coaxial antenna module 116 for joint operation. For example, the hard line coaxial cable 134 of the coaxial antenna module 116 extends generally through the insulator 150 positioned between the second radiating element 124 of the coaxial antenna module 116 and couples to a lower end portion of the match resonator's loading rod 154 (e.g., a central conductor of the hard line coaxial cable 134 couples to (e.g., via a welded connection, etc.) the loading rod 154, etc.). Accordingly, this positions the tunable match resonator 118 to operate with the coaxial antenna module 116 to vary the input impedance of the signals received and/or transmitted by the antenna assembly 100 (and the coaxial antenna module 116).

It should be appreciated that the first and/or second radiating elements 122 and/or 124 of the coaxial antenna module 116 and/or the match resonator radiating element 148 may be formed from any suitable electrically-conductive material such as, for example, copper, brass, bronze, nickel silver, stainless steel, phosphorous bronze, beryllium copper, etc. within the scope of the present disclosure. And, the radiating elements 122, 124, and/or 148 may be constructed by cutting, stamping, etc. the radiating elements 122, 124, and/or 148 from a sheet of such suitable material and then processed to a desired shape (e.g., rolled to a tubular shape, etc.).

With reference now to FIG. 7, voltage standing wave ratios (VSWRs) are illustrated in graph 180 by graphed line 182 for the example antenna assembly 100 described above and illustrated in FIGS. 1-6 over a frequency bandwidth of about 800 MHz to about 3000 MHz (with an intermediate frequency bandwidth (IFBW) of about 70 kilohertz).

As shown in FIG. 7, the antenna assembly 100 can operate at frequencies within multiple different bandwidths at VSWRs of at least about 2.5:1 or less. For example, the antenna assembly 100 can operate at frequencies within bandwidths ranging from about 804 MHz to about 829 MHz, from about 806 MHz to about 941 MHz, from about 855 MHz to about 980 MHz, from about 1660 MHz to about 1910 MHz, from about 1670 MHz to about 1920 MHz, from about 1790 MHz to about 2010 MHz, from about 1920 MHz to about 2170 MHz, and from about 2400 MHz to about 2500 MHz at such VSWRs. Reference numeral 184 indicates locations on the graph below which the antenna assembly 100 has a VSWR of about 2.5:1 or less. And, Table 1 identifies some example VSWR at different frequencies at eight reference locations shown in FIG. 7.

TABLE 1

Exemplary Voltage Standing Wave Ratios (VSWR)

| Reference Point | Frequency (MHz) | VSWR |
|---|---|---|
| 1 | 821 | 1.7676:1 |
| 2 | 896 | 1.2924:1 |
| 3 | 880 | 1.1317:1 |
| 4 | 960 | 2.0436:1 |
| 5 | 1850 | 1.6114:1 |
| 6 | 1990 | 1.2477:1 |
| 7 | 2400 | 1.6139:1 |
| 8 | 2500 | 1.1952:1 |

Example antenna assemblies (e.g., 100, etc.) of the present disclosure also exhibit gains ranging from unity to about 3 decibels isotropic (dBi). And, antenna assemblies (e.g., 100, etc.) of the present disclosure may provide capabilities of matching the transmission lines (e.g., 132, etc.) of the coaxial antenna modules (e.g., 116, etc.) using the variable features of the tunable match resonators (e.g., 118, etc.). For example, the tunable match resonators (e.g., 118, etc.) may allow for the antenna assemblies (e.g., 100, etc.) to be easily tuned to multiple resonant frequencies and bandwidths (e.g., those associated with the AMPS, GSM, PCS, KPCS, DCS, IDEN, UMTS, and ISM systems; those meeting office of emergency management requirements; those used in commercial markets, etc.). And, it should thus be appreciated that the antenna assemblies (e.g., 100, etc.) are capable of operating (e.g., capable of receiving and/or transmitting signals, etc.) within each of the AMPS, GSM, PCS, KPCS, DCS, IDEN, UMTS, and ISM systems.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A multi-band antenna assembly operable to receive and/or transmit signals at one or more frequencies, the antenna assembly comprising:

at least two radiating elements;

a transmission line coupled to each of the at least two radiating elements; and a tunable match resonator coupled to the transmission line; the tunable match resonator including a match resonator radiating element and a transformer moveable within the match resonator radiating element for varying input impedance of a signal received and/or transmitted by the antenna assembly by changing an electrical field within the tunable match resonator.

2. The antenna assembly of claim 1, wherein the at least two radiating elements are oriented in a generally stacked configuration.

3. The antenna assembly of claim 2, wherein the at least two radiating elements include two radiating elements that each define a radiating sleeve, and wherein the transmission line extends generally through each said radiating sleeve.

4. The antenna assembly of claim 1, wherein the transformer includes a balun and a dielectric load bushing.

5. The antenna assembly of claim 4, wherein the match resonator radiating element defines a radiating sleeve, and wherein the tunable match resonator further includes a loading rod coupled to the balun and dielectric load bushing, and extending generally through said radiating sleeve.

6. The antenna assembly of claim 5, wherein the balun and the dielectric load bushing are coupled to the loading rod by a threaded connection.

7. The antenna assembly of claim 1, wherein the tunable match resonator is operable to adjust the frequency bandwidth of signals capable of being received and/or transmitted by the antenna assembly.

8. The antenna assembly of claim 7, wherein the tunable match resonator is operable to adjust the frequency bandwidth of signals capable of being received and/or transmitted by the antenna assembly at least one or more of a bandwidth between about 804 MHz and about 829 MHz, a bandwidth between about 806 MHz and about 941 MHz, a bandwidth between about 855 MHz and about 980 MHz, to a bandwidth between about 1660 MHz and about 1910 MHz, a bandwidth between about 1670 MHz and about 1920 MHz, a bandwidth between about 1790 MHz and about 2010 MHz, a bandwidth between about 1920 MHz and about 2170 MHz, and a bandwidth between about 2400 MHz and about 2500 MHz.

9. The antenna assembly of claim 1, wherein the transmission line includes a coaxial cable.

10. The antenna assembly of claim 1, wherein the transmission line is capacitively coupled to each of the at least two radiating elements.

11. A network including the antenna assembly of claim 1.

12. A system including the antenna assembly of claim 1.

13. A tunable match resonator for an antenna assembly, the tunable match resonator comprising:

a generally tubular radiating element;

a loading rod disposed at least partially within the radiating element;

a balun coupled to the loading rod; and a dielectric load bushing coupled to the balun;

wherein the balun and the dielectric load bushing are disposed at least partially within the radiating element, the balun and the dielectric load bushing being moveable relative to the loading rod for varying input impedance of a signal received and/or transmitted by an antenna assembly by changing an electrical field within the tunable match resonator;

whereby the tunable match resonator is operable to adjust the frequency bandwidth of signals capable of being received and/or transmitted by an antenna assembly.

14. The tunable match resonator of claim 13, wherein the balun is coupled to the loading rod by a threaded connection.

15. The tunable match resonator of claim 13, wherein the dielectric load bushing is coupled to the balun by a pressure compression fit.

16. The tunable match resonator of claim 13, further comprising a support disposed at least partially within the radiating element, the support being configured to support the loading rod along a longitudinal axis of the radiating element.

17. The tunable match resonator of claim 13, wherein the tunable match resonator is operable to adjust the frequency bandwidth of signals capable of being received and/or transmitted by an antenna assembly to a bandwidth between about 804 MHz and about 829 MHz, to a bandwidth between about 806 MHz and about 941 MHz, to a bandwidth between about 855 MHz and about 980 MHz, to a bandwidth between about 1660 MHz and about 1910 MHz, to a bandwidth between about 1670 MHz and about 1920 MHz, to a bandwidth between about 1790 MHz and about 2010 MHz, to a bandwidth between about 1920 MHz and about 2170 MHz, and/or to a bandwidth between about 2400 MHz and about 2500 MHz.

18. A multi-band array antenna assembly operable to receive and/or transmit signals at one or more frequencies, the array antenna assembly comprising:

first, second, and third open-ended radiating tubes oriented in a generally stacked configuration;

a coaxial cable extending generally through each of the first and second radiating tubes;

a loading rod coupled to the coaxial cable and extending generally through the third radiating tube;

a balun coupled to the loading rod generally within the third radiating tube and moveable longitudinally relative to the loading rod within the third radiating tube; and a dielectric load bushing coupled to the balun;

wherein the balun and the dielectric load bushing are operable to vary input impedance of a signal received and/or transmitted by the array antenna assembly by changing an electrical field within the third radiating tube to thereby adjust the frequency bandwidth of signals capable of being received and/or transmitted by the array antenna assembly.

19. The array antenna assembly of claim 18, wherein the array antenna assembly is capable of receiving and/or transmitting signals within the Advanced Mobile Phone System (AMPS), Global System for Mobile communications (GSM), Personal Communications Service (PCS) system, Digital Cellular System (DCS), Integrated Digital Enhanced Network (iDEN), Universal Mobile Telecommunications System (UMTS), and/or Industrial, Scientific and Medical (ISM) system.

20. The array antenna assembly of claim 19, wherein the array antenna assembly is capable of receiving and/or transmitting signals within each of the Advanced Mobile Phone System (AMPS), Global System for Mobile communications (GSM), Personal Communications Service (PCS) system, Digital Cellular System (DCS), Integrated Digital Enhanced Network (iDEN), Universal Mobile Telecommunications System (UMTS), and/or Industrial, Scientific and Medical (ISM) system, and wherein the array antenna assembly exhibits a VSWR of about 2.5 or less for frequencies within each system.

21. The array antenna assembly of claim 20, wherein the array antenna assembly exhibits gain of at least about 3 decibels isotropic for frequencies within each system.

22. A method comprising providing a multi-band antenna assembly suitable for use with a base station subsystem, wherein the multi-band antenna assembly includes at least two radiating elements, a transmission line coupled to each of the at least two radiating elements, and a tunable match resonator coupled to the transmission line and operable by moving a balun and/or a dielectric load bushing of the tunable match resonator to vary input impedance of at least one or more signals received and/or transmitted by the multi-band antenna assembly by changing an electrical field within the tunable match resonator.

23. The method of claim 22, further comprising coupling the multi-band antenna assembly to a base station subsystem.

24. The method of claim 23, further comprising moving the balun and/or the dielectric load bushing of the tunable match resonator to vary the input impedance of the at least one or more signals received and/or transmitted by the multi-band antenna assembly and to thereby adjust the frequency bandwidth of signals capable of being received and/or transmitted by the multi-band antenna assembly.

25. The method of claim 22, wherein the tunable match resonator includes a match resonator radiating element defines a radiating sleeve in which the balun and the dielectric load bushing are at least partially disposed, and wherein the method comprises moving the balun and the dielectric load bushing within the radiating sleeve.

* * * * *